US006399865B1

(12) United States Patent
Ishimatsu

(10) Patent No.: US 6,399,865 B1
(45) Date of Patent: Jun. 4, 2002

(54) MUSICAL INSTRUMENT STAND

(75) Inventor: Norihiko Ishimatsu, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/650,449

(22) Filed: Aug. 29, 2000

(30) Foreign Application Priority Data

Aug. 30, 1999 (JP) ..... 11-242881

(51) Int. Cl.[7] ..... G10D 13/02
(52) U.S. Cl. ..... 84/421; 84/422.3
(58) Field of Search ..... 84/421, 427.3, 84/422.1, 422.2

(56) References Cited

U.S. PATENT DOCUMENTS

| | | | | | |
|---|---|---|---|---|---|
| 4,111,095 | A | * | 9/1978 | Simons | 84/422 R |
| 4,381,690 | A | * | 5/1983 | Kimble | 84/422 R |
| 4,945,802 | A | * | 8/1990 | Ruprecht | 84/422.1 |
| 5,018,426 | A | * | 5/1991 | Suzuki | 84/422.3 |
| 5,251,526 | A | * | 10/1993 | Kurosaki | 84/422.3 |
| 5,945,616 | A | * | 8/1999 | Hoshino | 84/422.3 |

FOREIGN PATENT DOCUMENTS

| | | |
|---|---|---|
| JP | 5-297863 | 11/1993 |
| JP | 11-15466 | 1/1999 |

* cited by examiner

*Primary Examiner*—Robert E. Nappi
*Assistant Examiner*—Kim Lockett
(74) *Attorney, Agent, or Firm*—Dickstein Shapiro Morin & Oshinsky LLP

(57) ABSTRACT

A musical instrument stand such as a hi-hat stand is basically constructed by a pair of cymbals, a stand member, a foldable tripod containing three legs, a pedal frame, an operation rod, a return spring, a transmission member, a pedal, a heel and an interconnection member. Normally, the return spring applies resilience to the operation rod, a lower end of which is being pressed upwardly together with a front end of the pedal by means of the transmission member. In addition, the interconnection member is formed in a U-shape, in which a bent portion is fixed to the heel of the pedal while ends are detachably attached to feet of the pedal frame. For storage and transportation of the musical instrument stand, the ends of the interconnection member being elastically deformed are disconnected from the feet of the pedal frame. Herein, straight portions of the interconnection member are held by holders, which are U-shape channels projecting downwardly from a back surface of the pedal. In addition, the pedal is lifted upwardly and is hooked on the stand member such that a pedal holding member, which is a hexagon head bolt being attached to the stand member, is engaged with a hole at a back-end portion of the pedal. This prevents the pedal and interconnection member from rotating and moving around when the musical instrument stand is transported. Thus, it is possible to improve transportability and portability of the musical instrument stand.

5 Claims, 4 Drawing Sheets

MUSICAL INSTRUMENT STAND

BACKGROUND OF THE INVENTION

1. Field of the Invention

This invention relates to stands used for musical instruments such as drum kits, and particularly to stands of hi-hat cymbals.

This application is based on Patent Application No. Hei 11-242881 filed in Japan, the content of which is incorporated herein by reference.

2. Description of the Related Art

Musical instruments such as drum kits consisting of sets of drums and cymbals use various types of stands such as stands of hi-hat cymbals (hereinafter, referred to as "hi-hat stands"). Herein, the hi-hat stand supports hi-hat cymbals, i.e., a pair of cymbals being arranged in a face-to-face manner.

FIG. 5 shows an example of a hi-hat stand which is conventionally used for performance of cymbals. A hi-hat stand 1 is constructed by a foldable tripod (or stand leg unit) 2 including three legs, a "hollow" stand member 3, an operation rod 4, a spring device 5 and a pedal device 6. The stand member 3 is fixed and supported by the stand leg unit 2, and the operation rod 4 penetrates through a hollow internal space of the stand member 3 to freely move up and down. The spring device 5 normally presses the operation rod 4 upwardly. The pedal device 6 is attached to a lower portion of the stand member 3. In addition, a lower fixed cymbal 7 is fixed to an upper portion of the stand member 3, while an upper moving cymbal 8 is attached to an upper portion of the operation rod 4. Thus, the lower fixed cymbal 7 and the upper moving cymbal 8 are arranged opposite to each other in a face-to-face manner.

The stand leg unit 2 includes three legs 9*a,* 9*b,* 9*c,* which are arranged in a triangular manner to encompass the stand member 3 with equal intervals of distance and angle therebetween. In addition, the stand leg unit 2 also includes a first metal fitting 10, three stays 11*a,* 11*b,* 11*c,* and a second metal fitting 12. Herein, the first metal fitting 10 interconnects upper ends of the legs 9*a,* 9*b,* 9*c* together. One ends of the stays 11*a,* 11*b,* 11*c* are interconnected with intermediate portions of the legs 9*a,* 9*b,* 9*c*. Another ends of the stays 11*a,* 11*b,* 11*c* are interconnected together by the second metal fitting 12. The first and second metal fittings 10, 12 are respectively fixed to selected positions of the stand member 3 by means of bolts. In order to transport and store the hi-hat stand 1 in some place, a human operator releases bolts of the first metal fitting 10 so that the first metal fitting 10 is moved upwardly along the stand member 3 and the stand leg unit 2 is folded together with the stand member 3.

The spring device 5 is constructed by a pipe 13 and a return spring (not shown). The pipe 13 is fixed to an outer periphery of the lower portion of the stand member 3, and the return spring is built in the pipe 13 to bring upward restoration properties in movements of the operation rod 4 and the pedal device 6. That is, the return spring presses upwardly the operation rod 4 and a pedal 16 of the pedal device 6.

The pedal device 6 is constructed by a pedal frame 14, a heel 15 and the pedal 16 as well as an interconnection member 17 and a transmission member 18. The pedal frame 14, which is placed on a floor, has an L-shape in side view and is attached to a lower end of the stand member 3. The pedal is equipped with the heel 15 at a back-end portion thereof, which is close to a performer. The interconnection member 17 is attached to the heel 15 and is detachably interconnected with the pedal frame 14. A front-end portion of the pedal 16, which is close to the stand member 3, is interconnected with the lower end of the operation rod 4 by means of the transmission member 18 such as a belt. In musical performance, a performer (or player) depresses the pedal 16 by his/her foot to pull down the operation rod 4 against upward spring force of the spring device 5, so that the upper moving cymbal 8 strikes the lower fixed cymbal 7. The interconnection member 17 is formed in a U-shape in plan view by bending a metal rod. In addition, end portions of the U-shaped interconnection member 17 are bent rectangularly in side directions to form hook portions. So, a bent portion (or an intermediate portion of the U-shape) of the interconnection member 17 is fixed to a lower surface of the heel 15, while the hook portions are detachably inserted into stop holes, which are formed at lower ends of the pedal frame 14. Using the U-shaped interconnection member 17, it is possible to secure a constant relative distance between the pedal frame 14 and the heel 15. This allows depression of the pedal 16 in a stable manner.

It is demanded that the hi-hat stand 1 can be transported and set for musical performance with ease. In addition, it is demanded that the hi-hat stand 1 can be stored in a small space. To meet the aforementioned demands, the hi-hat stand 1 is constructed such that the stand leg unit 2 is foldable. In addition, it is constructed such that the lower fixed cymbal 7 and the pedal frame 14 are detachably attached to the stand member 3, while the upper moving cymbal 8 is detachably attached to the operation rod 4. The pedal 16 is interconnected with the operation rod 4 by the transmission member 18, so it cannot be separated from the stand member 3 with ease. However, it can be separated from the pedal frame 14 by disconnecting the interconnection member 17 from the pedal frame 14.

The conventional hi-hat stand 1 lacks a fixing structure for fixing the pedal 16 to the stand member 3 although the pedal 16 can be separated from the pedal frame 14 by disconnecting the interconnection member 17 form the pedal frame 14. So, a human operator suffers from disadvantages in transportation of the stand member 3, as follows:

(1) When the human operator carries the stand member 3 being held horizontally while placing the pedal in a lower side, the pedal 16 hangs down so that it may rotate or move around in forward and backward directions as well as left and right directions. This is troublesome for the human operator to transport the hi-hat stand 1.

(2) When the human operator carries the stand member 3 on which the pedal 16 is put, it is difficult for the human operator to hold the stand member 3 by one hand. For this reason, the human operator must use both of his/her hands to hold the stand member 3 and the pedal 16 together. This causes a difficulty in transporting the hi-hat stand 1.

In addition, the conventional hi-hat stand lacks a holding structure for holding the interconnection member 17 together with the pedal 16 or stand member 3. So, if the human operator transports the hi-hat stand 1 in a condition where the pedal 16 hangs down from the stand member 3, the pedal 16 rotates or moves together with the stand member 3 being transported. In that case, there is a probability in that the pedal 16 which moves unintentionally is caught in or brought into contact with other musical instruments, objects and structures, for example. So, the human operator must pay a great attention to transportation of the hi-hat stand very carefully.

SUMMARY OF THE INVENTION

It is an object of the invention to provide a musical instrument stand which is improved in transportability. That is, the musical instrument stand is well designed to avoid unintentional movements of a pedal or interconnection member in transportation. In addition, it is designed to allow easy transportation using one hand of a human operator to completely hold the hi-hat stand.

A musical instrument stand of this invention is basically constructed by a pair of cymbals, a stand member, a foldable tripod containing three legs, a pedal device containing a pedal and a heel, a pedal frame, an operation rod, a return spring and an interconnection member. Herein, the return spring applies resilience to the operation rod, a lower end of which is being normally pressed upwardly together with a front end of the pedal by means of a transmission member. The interconnection member is formed in a U-shape, in which a bent portion is fixed to the heel of the pedal while ends are detachably attached to the pedal frame.

According to a first aspect of the invention, the stand member installs a pedal holding member that holds the pedal which is lifted upwardly by disconnecting the ends of the interconnection member from the pedal frame. In transportation of the musical instrument stand, the pedal does not hang down from the stand member. So, it is possible to prevent the pedal from rotating and moving around.

According to a second aspect of the invention, holders are attached to a back surface of the pedal to hold straight portions of the interconnection member. In transportation of the musical instrument stand, it is possible to prevent the interconnection member from being caught or brought in contact with other musical instruments, objects and structures.

Thanks to the provision of the pedal holding member and the holders for holding the interconnection member, the musical instrument stand can be folded in a compact manner, which improves portability in handling the musical instrument stand, so the human operator is capable of holding the musical instrument stand by one hand. Thus, it is possible to improve transportability of the musical instrument stand.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
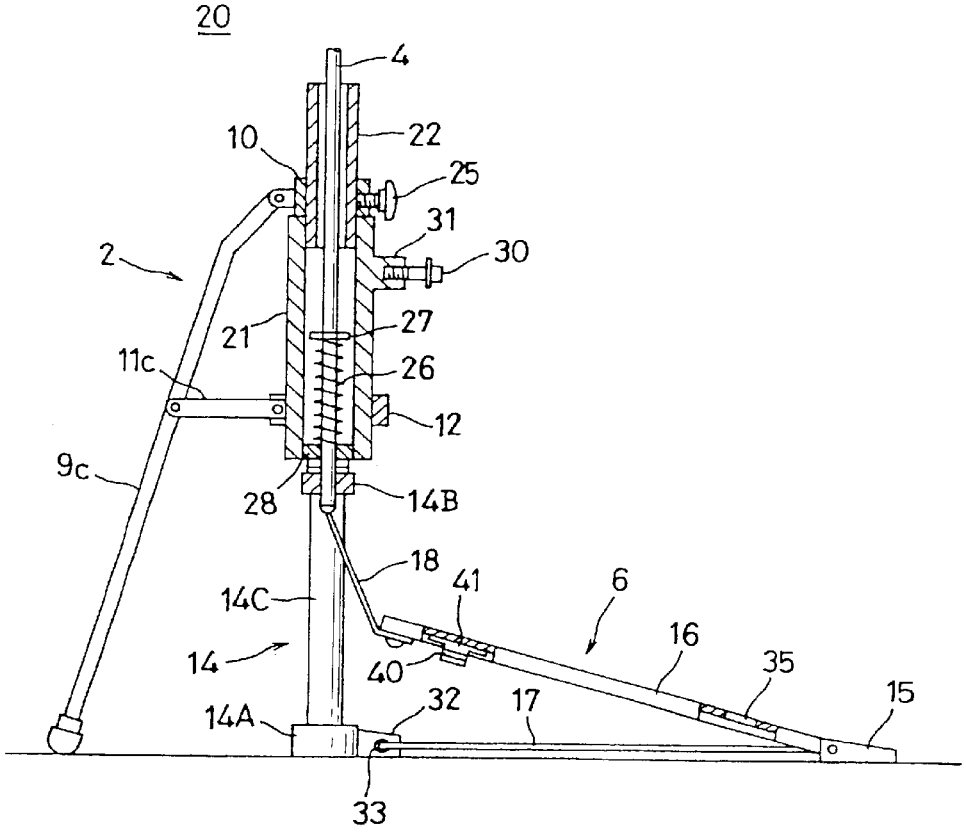
FIG. 1 is a side view partly in section showing essential parts of a hi-hat stand which is designed in accordance with a preferred embodiment of the invention.
Figure 2:
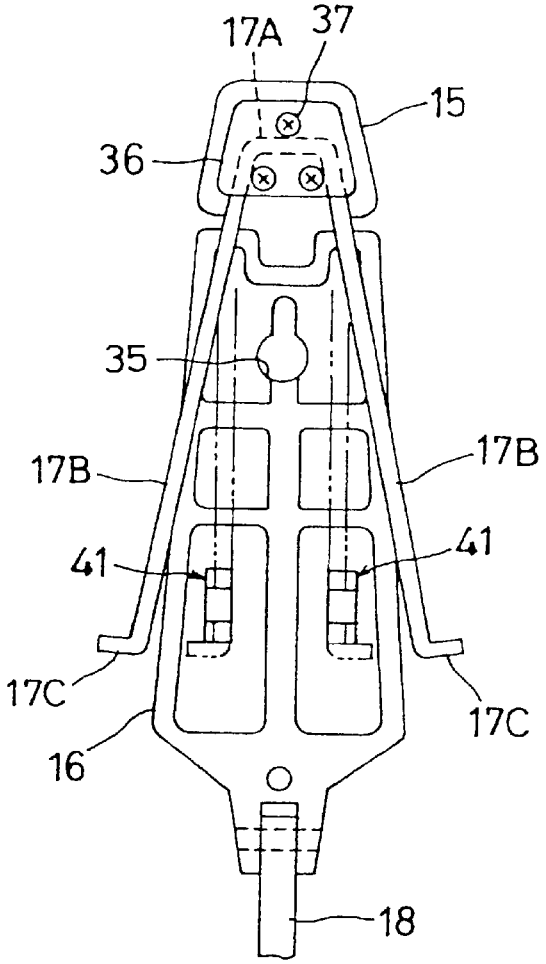
FIG. 2 is a bottom view showing a pedal and an interconnection member and their related members.
Figure 3:
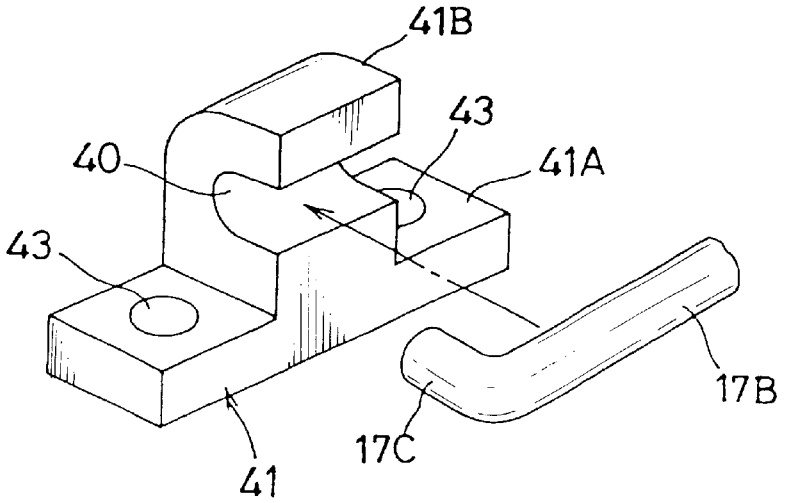
FIG. 3 is a perspective view showing a metal member for holding a hook portion corresponding to a rectangularly bent tip end portion of a straight portion of the interconnection member.
Figure 5:
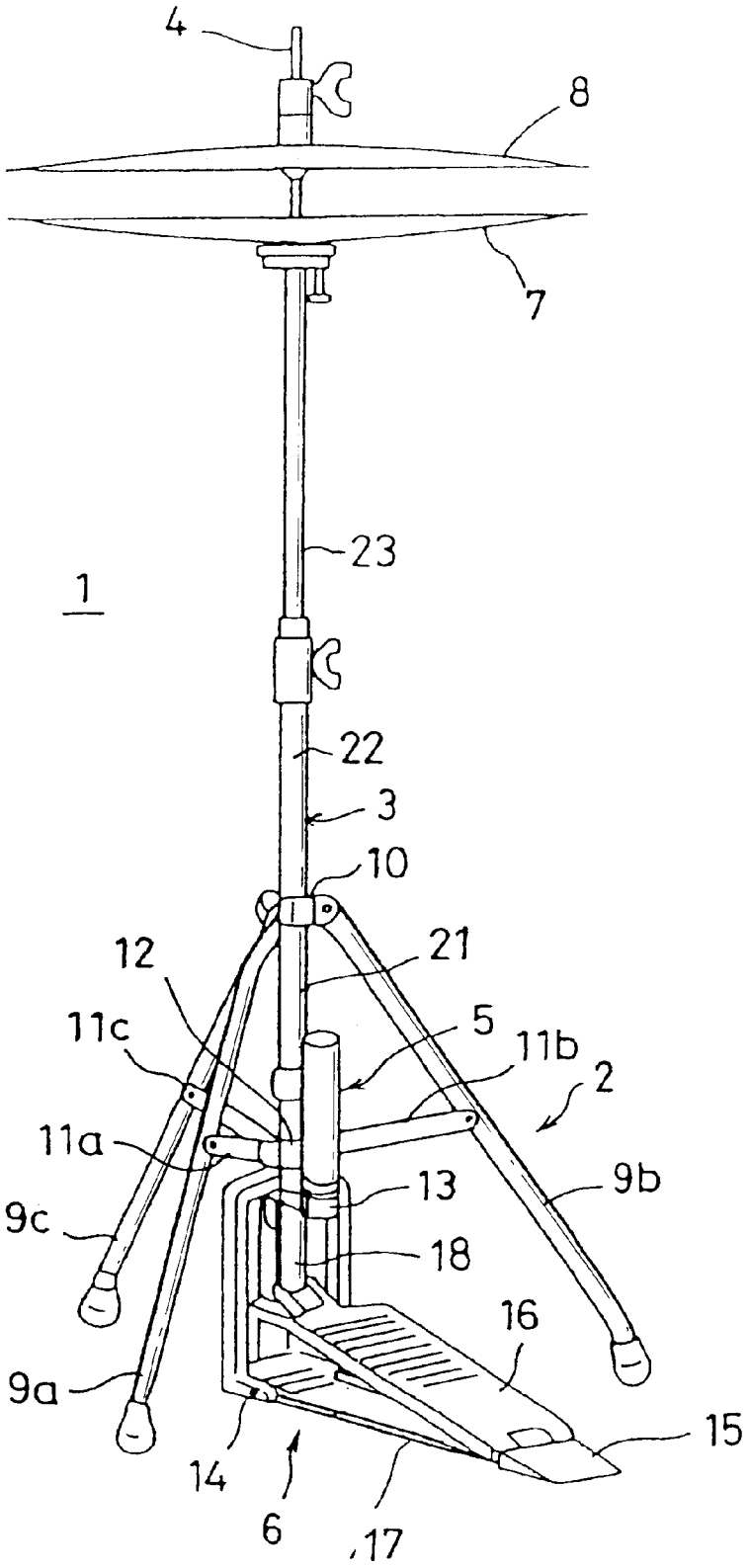
FIG. 5 is a perspective view showing an appearance of the conventional hi-hat stand.

FIG. 1 shows essential parts partly in section of a hi-hat stand which is designed in accordance with a preferred embodiment of the invention, wherein parts equivalent to those shown in FIG. 5 are designated by the same reference numerals, hence, the description thereof will be omitted. FIG. 2 shows essential parts in bottom view, particularly with respect to a pedal 16. FIG. 3 is a perspective view showing a holding structure with respect to an interconnection member 17.

With reference to FIGS. 1 to 3, the present embodiment shows a hi-hat stand 20 in which a return spring 26 is built inside of a stand member 3. The return spring 26 imparts restoration properties to an operation rod 4 and a pedal 16, which are normally pressed upwardly.

In FIG. 1, the hi-hat stand 20 is mainly constructed by a foldable stand leg unit 2 and the stand member 3 supported by a pedal device 6. The stand member 3 contains a lower pipe 21, an intermediate pipe 22 and an upper pipe 23 (see FIG. 5). The intermediate pipe 22 is connected with an upper end of the lower pipe 21. The operation rod 4 penetrates through internal spaces of the pipes 21, 22, 23, in which it freely moves up and down. For convenience' sake, FIG. 1 shows only a leg 9*c* of the stand leg unit 2, wherein an upper end of the leg 9*c* is connected to a selected position of an outer periphery of the intermediate pipe 22 by means of a first metal fitting 10, which is fixed using a screw 25. In addition, an end of a stay 11*c* which is interconnected with an intermediate portion of the leg 9*c* is connected to a selected position of an outer periphery of the lower pipe 21 by means of a second metal fitting 12. As shown in FIG. 5, a lower fixed cymbal 7 is attached to an upper end of the upper pipe 23 in an upward manner, while an upper moving cymbal 8 is attached to an upper end of the operation rod 4 in a downward manner.

In FIG. 1, a lower end of the lower pipe 21 is fixed to an upper end of a pedal frame 14 of the pedal device 6. The return spring 26 is installed inside of the lower pipe 21. An upper end of the return spring 26 is pressed in contact with a spring bearing ring 27 which is provided for the operation rod 4. In addition, a lower end of the return spring 26 is pressed in contact with a cover member 28 which closes an opening of a lower end of the lower pipe 21. A lower end of the operation rod 4 penetrates through a through hole of the cover member 28 to project downwardly from the stand member 3. A pedal holding member 30 is formed at a selected position on an outer periphery of an upper portion of the lower pipe 21. The pedal holding member 30 holds the pedal 16 to be stopped for storage and transportation of the hi-hat stand 20. Specifically, the pedal holding member 30 is constructed by a hexagon head bolt with pin holes, which is put into a tapped hole of a projecting portion 31 which projects from the outer periphery of the upper portion of the lower pipe 21. Incidentally, the pedal holding member 30 is not necessarily limited to such a specific parts like the bolt being attached to the lower pipe 21. Hence, it can be designed as a simple projection which is formed integrally with the lower pipe 21.

The pedal frame 14 is formed in a rectangular shape in front view. That is, the rectangular shape of the pedal frame 14 is constructed by four parts, namely, a lower frame 14A, an upper frame 14B and a pair of side supports 14C. Herein, the lower frame 14A and upper frame 14B are arranged being opposite to each other in a vertical direction, and the side supports 14C are arranged to support and connect left and right ends of the lower and upper frames 14A, 14B. The lower frame 14A is placed on a floor, and the lower end of the stand member 3 is installed and fixed to a center portion of an upper surface of the upper frame 14B. The lower end of the operation rod 4 is extended downwardly from the upper frame 14B. Feet 32 having stop holes 33 are formed integrally with end portions of the lower frame 14A, wherein they project in a direction toward the pedal 16. The stop holes 33 hold the interconnection member 17 to be stopped in position for storage and transportation of the hi-hat stand 20. Concretely speaking, the stop holes 33 are formed to penetrate the feet 32 from exterior surfaces to interior surfaces.

A front-end portion of the pedal 16 is connected with the lower end of the operation rod 4 by means of a transmission member 18 such as a belt. A back-end portion of the pedal 16 is connected with a heel 15 by a pin. A hole 35 like a keyhole is formed at a center position in a width direction of the back-end portion of the pedal 16. Hence, the pedal 16 is hooked on the aforementioned pedal holding member 30, which is being inserted into the hole 35.

An interconnection member 17 detachably interconnects the pedal frame 14 and the heel 15 together. The interconnection member 17 is formed by a U-shape by bending a metal rod having an appropriate outer diameter. A bent portion 17A, which is an intermediate portion of the U-shape interconnection member 17 being bent, is fixed to a lower surface of the heel 15. Fixing the bent portion 17A of the interconnection member 17 to the heel 15 is made by a fixing plate 36. That is, the bent portion 17A is sandwiched between the heel 15 and the fixing plate 36, which are held together by setscrews 37. Thus, the bent portion 17A is fixed to the lower surface of the heel 15.

The interconnection member 17 contains a pair of straight portions 17B in addition to the bent portion 17A. Herein, the straight portions 17B extend in left and right sides in a slanted manner that intervals between them are gradually broadened toward their tip ends. An interval of distance between the tip ends of the straight portions 17B is set greater than an interval of distance between the feet 32 of the lower frame 14A. In addition, hook portions 17C are formed by rectangularly bending the tip ends of the straight portions 17B in left and right directions respectively. The hook portions 17C are respectively inserted into the stop holes 33 of the feet 32 from their interiors. Insertion and extraction of the hook portions 17C in the stop holes 33 can be made easily by elastically deforming the straight portions 17B in an inward direction.

A pair of holders 40 are attached to a back surface of the front-end portion of the pedal 16 on its both sides. For storage and transportation of the hi-hat stand 20, the holders 40 hold the straight portions 17B of the interconnection member 17, which are prevented from being moved. Details of the holder 40 is shown in FIG. 3, wherein the holder 40 is actualized by a U-shape channel, which is formed on a metal member 41 and is turned sideways.

Specifically, the metal member 41 is mainly constructed by a base 41A and a projecting portion 41B. The base 41A has screw holes 43 at both sides thereof. The projecting portion 41B having the U-shape channel 40 projects on a center portion of an upper surface of the base 41A. So, the metal member 41 is fixed to a selected side position of the back surface of the pedal 16 by screws (or vises) such that the U-shape channel 40 turns to a center of the pedal 16. The interconnection member 17 can be easily held by the U-shape channels 40, as follows:

The straight portions 17B are elastically deformed in an inward direction (see dashed lines in FIG. 2). Using resilience of the straight portions 17B, the hook portions 17C are inserted and engaged with the U-shape channels 40.

As the holders that hold the interconnection member 17, the present embodiment employs the U-shape channels 40, which are formed on the metal members 41. Of course, the holders are not necessarily limited to the U-shape channels. For example, they can be actualized by projections, each of which has the same shape of the metal member 41 and which are formed integrally with the pedal 16 to project downwardly from the back surface. Herein, the projections have channels like the U-shape channels for holding the hook portions 17C of the interconnection member 17.

Figure 4A:
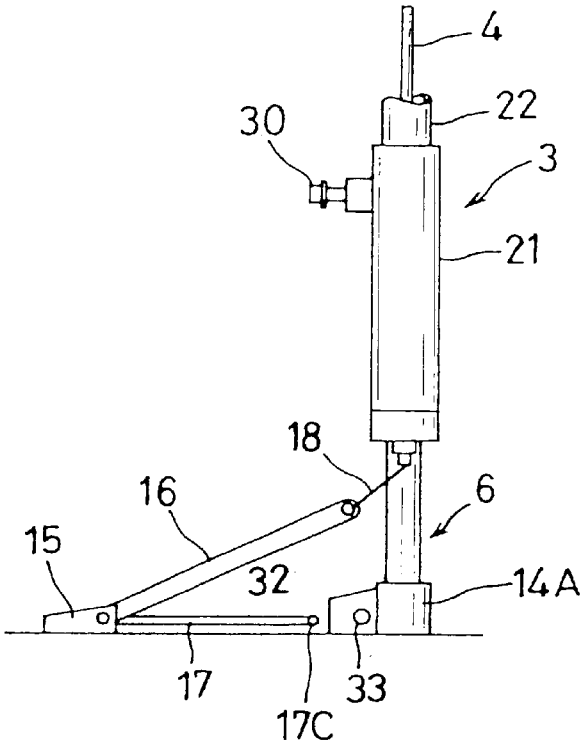
FIG. 4A is a side view showing selected parts of the hi-hat stand in which the interconnection member is disconnected from a lower frame.
Figure 4B:
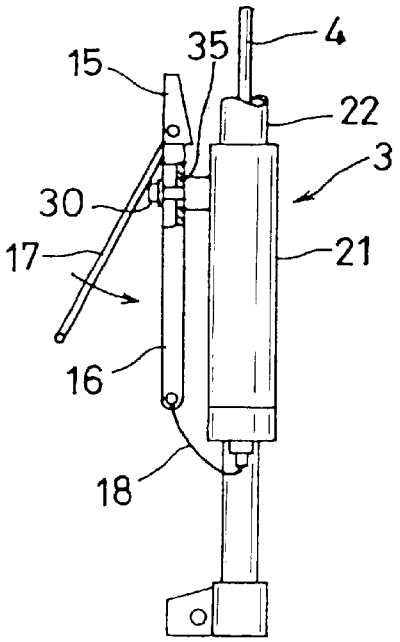
FIG. 4B is a side view showing the selected parts of the hi-hat stand in which the pedal is held on a stand member for transportation and storage.

For transportation of the hi-hat stand 20 having the aforementioned construction, the pedal 16 can be fixedly held along an outer periphery of the stand member 3. A series of operations for holding the pedal 16 with the stand member 3 will be described with reference to FIGS. 4A and 4B. That is, as shown in FIG. 4A, the hook portions 17C of the interconnection member 17 are extracted from the stop holes 33 of the feet 32 of the lower frame 14A, so that the interconnection member 17 is separated from the lower frame 14A. Next, as shown in FIG. 4B, the pedal 16 is raised such that the heel 15 becomes higher than the pedal 16 in elevation. Herein, the pedal holding member 30 of the stand member 3 is engaged with the hole 35 of the pedal 16. Thus, it is possible to hold and stop the pedal 16 along the outer periphery of the lower pipe 21. In addition, the straight portions 17B of the interconnection member 17 are elastically deformed in the inward direction, so that the hook portions 17C are engaged with the holders (i.e., U-shape channels) 40 from interiors. Thus, it is possible to hold and stop the interconnection member 17 along the back surface of the pedal 16.

Thanks to the aforementioned construction of the hi-hat stand 20, the pedal 16 does not hang down from the stand member 3 to rotate or move around in forward and backward directions in transportation. In addition, the human operator is capable of holding and carrying the stand member 3 with one hand with ease. Further, the interconnection member 17 is stopped on the back side of the pedal 16. Hence, there is no probability in that the interconnection member 17 collides or comes in contact with other musical instruments, objects and structures. Thus, it is possible to improve transportability of the hi-hat stand 20, particularly the stand member 3.

Moreover, even when the hi-hat stand 20 is stored or extracted from some storage, the pedal 16 and the interconnection member 17 do not move independently of the stand member 3, so it is easy for the human operator to store and extract the hi-hat stand 20 from the storage.

The present embodiment exclusively describes application of this invention to the hi-hat stand. Of course, the application of this invention is not necessarily limited to the hi-hat stands. Namely, this invention can be applied to all other musical instrument stands which are equipped with pedal devices.

In addition, the present embodiment narrowly describes the application of this invention to the hi-hat stand 20 in which the return spring 26 is built inside of the stand member (or pipe) 3. However, this invention can be naturally applied to the foregoing hi-hat stand shown in FIG. 1 in which the spring device 5 installing the return spring is provided outside of the stand member 3.

Further, the pedal holding member 30 for holding the pedal 16 is not necessarily limited to the bolt, so it is possible to employ a variety of tools having different shapes. For example, the pedal holding member can be made by a synthetic-resin material which elastically holds the pedal 16 or heel 15. Furthermore, the stand member 3 does not necessarily provide with a single pedal holding member. That is, by providing two or more pedal holding members, it is possible to further improve reliability in holding the pedal on the stand member.

As described heretofore, this invention has a variety of effects and technical features, which are summarized as follows:

(1) The musical instrument stand (e.g., hi-hat stand) of this invention is designed to have a capability of holding the pedal on the stand member. This prevents the pedal from being hung down in transportation of the musical instrument stand. In other words, it is possible to prevent the pedal from rotating and moving in forward and backward direction as well as left and right directions. Hence, it is possible for the human operator to transport the musical instrument stand with ease.

(2) The musical instrument stand of this invention is also designed to have a capability of holding the interconnection member together with the pedal. So, there is no probability in that the interconnection member is caught or brought in contact with other musical instruments, objects and structures. Hence, this invention offers an easy way for transportation of the musical instrument stand.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical instrument stand comprising:

a stand member;

a pedal device which is attached to a lower portion of the stand member;

a pedal frame which vertically supports the stand member;

a foldable stand leg unit containing a plurality of legs that support the stand member together with the pedal device;

a pedal holding member which is provided on the stand member to hold a pedal of the pedal device for storage and transportation; and holders on the pedal, wherein the holders hold an interconnection member, a bent portion of which is fixed to a heel of the pedal and ends of which are normally attached to a pedal frame and are detached from the pedal frame for storage and transportation.

2. A musical instrument stand comprising:

a pair of a lower fixed cymbal and an upper moving cymbal which are arranged in a face-to-face manner;

a stand member, an upper end of which is fixedly connected with the lower fixed cymbal;

a foldable tripod containing three legs that vertically support the stand member;

a pedal device containing a pedal and a heel;

a pedal frame that vertically supports the stand member together with the pedal device which is placed horizontally;

an operation rod which is inserted in the stand member, wherein an upper end of the operation rod is connected with the upper moving cymbal and a lower end of the operation rod is connected with a front end of the pedal by means of a transmission member;

a return spring which applies resilience to the operation rod being normally pressed upwardly with the front end of the pedal; and an interconnection member having a U-shape, a bent portion of which is fixed to the heel of the pedal and ends of which are detachably attached to the pedal frame, so that the pedal device is securely placed in a desired position being defined by the pedal frame, wherein the stand member has a pedal holding member that holds the pedal which is lifted upwardly by disconnecting the ends of the interconnection member from the pedal frame, and wherein the pedal has holders that hold straight portions of the interconnection member.

3. A musical instrument stand according to claim 2 wherein the pedal holding member is a bolt, which is engaged with a hole being formed on a back-end portion of the pedal.

4. A musical instrument stand according to claim 2 wherein the pedal frame has feet having stop holes into which the ends of the interconnection member being elastically deformed are respectively inserted.

5. A musical instrument stand according to claim 2 wherein the holders are actualized by U-shape channels which are turned sideways and project downwardly from a back surface of the pedal.

* * * * *